US005284009A

United States Patent [19]

Tung et al.

[11] Patent Number: 5,284,009

[45] Date of Patent: Feb. 8, 1994

[54] FIBER BLENDS FOR IMPROVED CARPET TEXTURE RETENTION

[75] Inventors: Wae-Hai Tung, Seaford, Del.; Leif R. Simonsen, Salisbury, Md.; Yashavant V. Vinod, Hockessin, Del.; Frank Werny, West Chester, Pa.

[73] Assignee: E. I. Du Pont de Nemours and Company, Wilmington, Del.

[21] Appl. No.: 28,112

[22] Filed: Mar. 9, 1993

[51] Int. Cl.[5] ..... D02G 3/02

[52] U.S. Cl. ..... 57/239; 57/236; 57/238; 57/252; 57/254; 428/92; 428/97; 428/198; 428/362; 428/369; 428/370; 428/374; 428/296

[58] Field of Search ..... 57/238, 239, 236, 252, 57/254, 255, 256; 428/357, 364, 362, 198, 369, 92, 97, 370, 374, 296, 365

[56] References Cited

U.S. PATENT DOCUMENTS

| | | | |
|---|---|---|---|
| 3,358,434 | 12/1967 | McCann | 57/238 |
| 3,494,822 | 2/1970 | Weldon | 161/172 |
| 3,534,540 | 10/1970 | Collingwood et al. | 57/140 |
| 3,616,031 | 10/1971 | Fleissner | 156/285 |
| 3,831,368 | 8/1974 | Glowacki | 57/239 |
| 3,950,937 | 4/1976 | Durling | 57/239 |
| 3,978,267 | 8/1976 | Selwood | 428/360 |
| 4,424,250 | 1/1984 | Adams et al. | 428/198 |
| 4,729,214 | 3/1988 | Yngve et al. | 57/239 |
| 4,839,211 | 6/1989 | Wilkie et al. | 428/89 |
| 4,870,813 | 10/1989 | Nelson | 57/236 |
| 4,871,604 | 10/1989 | Hackler | 428/96 |
| 4,882,222 | 11/1989 | Talley, Jr. et al. | 428/362 |
| 5,058,371 | 10/1991 | Yu et al. | 57/239 |
| 5,102,713 | 4/1992 | Corbin et al. | 428/92 |
| 5,175,038 | 12/1992 | Tung et al. | 428/369 |

FOREIGN PATENT DOCUMENTS

| | | |
|---|---|---|
| 324773 | 9/1987 | European Pat. Off. . |
| 430916 | 11/1990 | European Pat. Off. . |
| 60-224831 | 11/1985 | Japan . |
| 1501871 | 2/1975 | United Kingdom . |
| 2205116 | 5/1988 | United Kingdom . |

*Primary Examiner*—Patrick J. Ryan
*Assistant Examiner*—N. Edwards

[57] ABSTRACT

The present invention relates to ply-twisted yarns comprising fiber blends of about 70 to 90 weight percent base fiber and about 10 to 30 percent non-melt compatible polyolefin fiber having a melting point of about 130° to 170° C. The base fiber may be polyamides, polyesters, or fiber mixtures thereof. The ply-twisted yarns may be heat-set by a conventional process, whereupon the polyolefin fibers melt and bond to each other but do not bond to the base fibers.

7 Claims, No Drawings

FIBER BLENDS FOR IMPROVED CARPET TEXTURE RETENTION

BACKGROUND OF THE INVENTION

1. Field of the Invention

This invention relates to novel ply-twisted yarns which may be used as pile yarn in a carpet to improve the carpet's texture retention. The yarns are composed of a blend of polyamide and/or polyester fibers and non-melt compatible polyolefin fibers.

2. Description of the Related Art

A large portion of carpets used in residences in the United States are known as cut pile saxony carpets. In saxony carpets, pile yarn is inserted into a backing material as loops which are cut to form vertical tufts. The tufts are then evenly sheared to a medium-length height. The cut ends of the tufts are referred to as the tuft tips. Generally, there are two different styles of saxony carpets: 1) a straight-set style in which the tufts are straight and substantially perpendicular to the plane of the carpet face, and 2) a textured style in which the tufts have varying degrees of curl.

Staple fiber, which refers to cut lengths of fiber from continuous filaments, may be processed into yarn suitable for saxony carpets by techniques known in the art. Generally, such techniques involve first combing crimped staple fiber in a carding machine to form sliver which is a continuous strand of loosely assembled fibers without twist. The sliver is then drafted on a drafting machine to improve its thickness uniformity and subsequently spun and twisted on a spinning machine to form singles twisted yarn. The singles twisted yarn may then be twisted with other singles twisted yarn(s) to form a ply-twisted yarn. Finally, the ply-twisted yarn is subjected to a heat-setting operation where the twist in the yarn is heat-set, thus making the yarn suitable for tufting.

It is important that the staple spun yarn have a high degree of thickness uniformity. The thickness uniformity of the staple spun yarn not only affects the quality of the finished carpet, but it also affects any subsequent processing steps. For instance, staple spun yarns with poor uniformity have a high number of thick and thin sections which greatly weaken the yarns, causing frequent fiber breaks during the ply-twisting phase. One object of the present invention is to produce a staple spun yarn having a high degree of thickness uniformity.

Secondly, the perceived value of saxony carpets is dependent upon several factors including carpet bulk and carpet "texture retention." By the term, "texture retention" as used herein, it is meant the ability of the carpet to retain its original tuft definition after being subjected to traffic. It is known that carpet bulk can be improved by increasing the face weight of the carpet or by increasing the crimp imposed on the staple fiber. However, carpet face weight is directly proportional to the carpet's total production cost. Furthermore, highly crimped staple fiber can create processing problems, especially during the carding operation. Another object of this invention is to produce yarns which may be tufted into carpets to provide good carpet bulk in such a manner that the above problems are avoided.

When saxony carpets are new, they have a pleasing texture. The bulked yarns which form the tufts provide firmness and body to the carpet. The ply-twist in the individual tufts allow for good tuft definition which gives the carpet a uniform and sharp appearance. Each tuft appears distinctly separate from neighboring tufts. However, when the carpet is subjected to a high degree of traffic, the tufts begin to untwist. This loss of twist causes the tuft tips to splay open. The individual filaments of one tuft tend to mingle with filaments of adjacent tufts giving the carpet a matted appearance and loss of texture. A still further object of this invention is to produce yarns which will impart improved texture retention to carpets.

Those skilled in the art have considered different ways for improving carpet texture retention. One method involves increasing the number of twists in the ply-twisted yarn. However, increasing the twist decreases carpet bulk and increases yarn production costs.

In other instances, yarns composed of a mixture of base fibers and potentially adhesive binder fibers may be prepared. Upon heat treatment, these binder fibers are activated and adhere to the base fibers in such a manner that the base fibers are bonded together. As mentioned in published UK Patent Application 2,205,116, the binder fibers may be bicomponent fibers in which one component of the fiber melts and becomes adhesive at a lower temperature than the other component in the fiber, or the binder fibers may be single component fibers in which the melting temperature is similar throughout the fiber. These binder fibers may also melt to such a degree that they substantially lose their identity as fibers, as described in published European Patent Specification 324,773. The above-described binder fibers may be referred to as "melt compatible" binder fibers, since the binder fibers have a chemical affinity with the base fibers and upon melting adhere to the base fibers.

The present invention provides a new yarn composed of a blend of polyamide and/or polyester fibers and "non-melt compatible" polyolefin fibers. By the term "non-melt compatible" as used herein, it is meant that upon heat activation, the polyolefin fibers will melt and adhere to other molten polyolefin fibers, but there is no adhesion between the polyolefin fibers and polyamide or polyester fibers. It has been found that these yarns have a high degree of thickness uniformity and provide good carpet bulk and improved texture retention.

SUMMARY OF THE INVENTION

The present invention relates to ply-twisted yarns comprising fiber blends of about 70 to 90 weight percent base fiber selected from the group consisting of polyamide fibers, polyester fibers, and fiber mixtures thereof, and about 10 to 30 weight percent non-melt compatible polyolefin fiber having a melting point of about 130° C. to 170° C. The base fiber is preferably crimped nylon 6,6 or nylon 6 fiber having a denier per filament of about 6 to 25. The polyolefin fiber is preferably crimped or uncrimped polypropylene having a denier per filament of about 3 to 25. Preferably, the weight percent of nylon fibers is 75 to 85%, and the weight percent of polypropylene fibers is 15 to 25%. The fibers may be staple fibers or bulked continuous filaments. The ply-twisted yarns of this invention may be heat-set by conventional processes at temperatures ranging from about 180° C. to 220° C. During heat-setting, the polyolefin fibers melt and bond to each other, but do not bond to the base fibers.

DETAILED DESCRIPTION OF THE INVENTION

The present invention relates to yarns which are especially suitable for use in cut pile saxony carpets. The yarns are composed of a blend of about 70 to 90 percent by weight of base fibers, i.e., polyamide and/or polyester fibers, and about 10 to 30 percent by weight of non-melt compatible polyolefin fibers having a melting point in the range of about 130° C. to 170° C.

The component polyamide, polyester, and polyolefin fibers which form the yarns of this invention may be prepared by conventional techniques. Generally, polymer flakes or pellets are melted and extruded through a spinneret into cool air where the material solidifies to form filaments. The filaments are then drawn, i.e., stretched, in order to align the molecules along the fiber axis and stabilize the fiber structure. Finally, the filaments are subjected to a bulking operation such as hot air-jet bulking, gear crimping, or stuffer box system, whereby crimp and bulk are imparted into the filaments. Short lengths of fiber may then be cut from the continuous filaments to produce staple fiber.

Suitable fiber-forming polymers for the base fiber include polyamides, such as nylon 6,6 (polyhexamethylene adipamide) with a melting point of about 260° C., and nylon 6 (polycaproamide) with a melting point of about 230° C. The fibers may also be prepared from the copolymers of the above nylons, and copolymers of hexamethylene adipamide and hexamethylene-5-sulfoisophthalamide, as described in Anton, U.S. Pat. No. 5,108,684. Other suitable fiber-forming copolymers and terpolymers may include units of diacids such as isophthalic acid, terephthalic acid, and the like, and units of diamines such as 2-methylpentamethylene- diamine, and the like. Preferably, nylon 6,6 is used. Polyesters, such as polyethylene terephthalate with a melting point of about 265° C. are also suitable. The base fibers are typically crimped and have a denier per filament (dpf) of about 6 to 25.

Polyolefin fibers suitable for use in the fiber blend have a melting point in the range of about 130° C. to 170° C. Preferably, polypropylene fibers having a melting point of about 165° C. are used. The polyolefin fibers may be crimped or uncrimped and typically have a denier per filament (dpf) of about 3 to 25. It is understood that the component fibers may contain conventional additives, such as delustrants, UV stabilizers, antioxidants, etc. The polyolefin and base fibers may also be precolored with assorted pigments to produce a fiber blend having a single or mixed colortone depending upon the desired effect in the carpet yarn.

In one embodiment of the invention, staple polypropylene fibers are blended with staple nylon 6,6 fibers during the carding operation. The fibers should be blended thoroughly in order to avoid clumps of fiber in the finished carpet. Furthermore, it is critical that the staple fiber blend contain about 10 to 30 percent and preferably 15 to 25 percent by weight (wt. %) polypropylene fiber. If the fiber blend contains greater than 30 wt. % polypropylene fiber, then upon heat-activation and subsequent cooling, there tends to be excessive bonding between the polypropylene fibers resulting in a yarn which has a harsh hand. Conversely, if the fiber blend contains less than 10 wt. % polypropylene fiber, then upon heat-activation and subsequent cooling, there tends to be insufficient bonding between the polypropylene fibers resulting in a yarn which gives poor texture retention in carpets.

The amount of base fiber in the blend should be about 70 to 90 wt. %. However, it is recognized that the blend may contain a minor amount of other fibers, including, for example, antimicrobial and antistatic fibers, provided that such fibers do not interfere with the bonding action of the polyolefin fibers. Furthermore, the base fiber, itself, may be a mixture of fibers. For instance, the base fiber may be a mixture of nylon and polyester fibers in various proportions, provided that the yarn, i.e., the ultimate fiber blend, contains about 70 to 90 wt. % base fiber.

Preferably, staple fiber blends are prepared, because it is easier to blend such fibers versus continuous filaments. However, it is recognized that continuous filament blends may also be produced in accordance with this invention by such methods as described in Bankar, U.S. Pat. No. 5,032,333.

A ply-twisted yarn is then produced from the fiber blend. This type of yarn may be made by cabling together two or more singles yarns either by a two-step twisting/cabling process or a direct cabling process, both of which are familiar to those skilled in the art. One advantage of the present invention is that the fiber blends described herein have better spinning/twisting processability and more uniform yarn thickness than conventional 100% nylon or polyester products.

Subsequently, the twist in the yarns is heat-set. Generally, conventional heat-setting operations may be used where the temperature ranges from about 180° to 220° C. within a heat-setting chamber.

With staple ply-twisted yarn, the yarn is preferably passed through a continuous heat-setting machine known as a Suessen. In such an operation, the yarn is placed on a conveyer belt or ropes which move through the heat-setting chamber. In the heat-setting chamber, the yarn is treated with dry heat to heat-set the twist and mechanically stabilize the yarn structure. For nylon 6,6 yarns, the temperature within the heat-setting chamber is generally in the range of about 190° C. to 210° C.

During the heat-setting step, only the polyolefin fibers are activated to a point where they soften and melt. The molten fiber then flows to contact points of other molten polyolefin fibers, i.e., points where polyolefin fibers intersect and/or touch each other. Upon subsequent cooling, the molten fibers resolidify and there is bonding at the contact points along the length of the yarn. It is important that a substantial amount of the fibers maintain their basic integrity during the melting process. As discussed above, the concentration of the polyolefin fibers is critical. If the concentration is too high, i.e. greater than 30%, an excessive amount of contact points between the polyolefin fibers will form, thereby giving the yarn a harsh hand. It is equally important that the concentration not be too low, i.e., less than 10%, because in such instances, there will be an insufficient amount of contact points formed between the polyolefin fibers. Carpets prepared from such yarns will demonstrate insufficient texture retention in accordance with this invention.

A key feature of the yarns in this invention is the lack of chemical affinity between the polyolefin and base fibers. Since the polyolefin and base fibers are not melt compatible, they do not adhere to each other. Consequently, the molten polyolefin fibers do not stick to the base fibers to form durable bonds between adjacent base fibers. Rather, the molten polyolefin fibers simply bond to each other at contact points along the length of yarn.

The resulting yarns may be processed and tufted into a carpet backing material to form different types of carpets. In one style, the yarns may tufted into the backing material as loops which are then cut and sheared to form a cut-pile saxony carpet, as discussed above. As customary in the trade, the carpet may then be subjected to further processing including dyeing and finishing.

It has been found that carpets made with yarns of this invention exhibit good texture retention. The carpets also have a soft hand and good bulk.

The following examples further illustrate the invention but should not be construed as limiting the scope of the invention.

TESTING METHODS

Wear

Wear tests which closely correlate to floor trafficking were conducted in a Vetterman drum test apparatus, Type KSG manufactured by Schoenberg & Co. Baumberg, Fed. Rep of Germany), according to ISO (International Standards Organization) document TC38/12/WG 6 N 48. As specified, the drum is lined with carpet samples into which is placed a 16 pound steel ball having fourteen (14) rubber buffers which rolls randomly inside the rotating drum. A circular brush within the drum is in light contact with the carpet surface and picks up loose pile fibers which are continuously removed by suction. After 5,000 cycles, the samples are removed and inspected to evaluate texture retention. Texture retention is reported on a scale of 1–5 with a rating of 5 corresponding to an untested control sample, 4 corresponding to a lightly worn sample, 3 to a moderately worn sample, and 2.5 to the turning point from acceptable to unacceptable wear. A rating of 2 corresponds to clearly unacceptable wear, and 1 corresponds to an extremely matted sample.

Reu Bulk

Carpet bulk was measured as the compressed pile height in inches of a carpet sample that is loaded with a pressure of 1 lb/in$^2$ (703 kg/m$^2$). The carpet sample is placed on a platform which is attached to a vibrator. The sample is vibrated lightly for 10 seconds prior to measuring the pile height using a thickness gauge, which is also attached to the vibrating platform. The vibration allows the foot of the thickness gauge to settle into the surface of the carpet. Carpets with high bulk values have high readings of Reu bulk.

Yarn Uniformity

Spun yarn uniformity was measured on a commercial Ulster 1 machine at 400 yards per minute and reported as CV which is defined as:

$$CV = \frac{\text{the standard deviation of yarn diameter}}{\text{the average of yarn diameter}} \times 100\%$$

For each item, 5 test tubes from 5 different spinning positions were tested on the Ulster machine for one minute and the results were averaged and tabulated in the following examples. Staple spun yarns with low CV values have a more uniform appearance and better processability than spun yarns with higher CV values.

EXAMPLES

Example 1

A 12 melt flow index polypropylene polymer (WSR-5-970, available from Shell Chemicals) was melt spun through a 332 hole spinneret at 361 yards per minute through a quench zone and was then coated with a lubricant for drawing. The coated yarn was drawn at 1280 yards per minute (3.85×draw ratio) and wound on a tube. The yarn was subsequently cut off line into 7.5 inch length staple fiber. The resulting fiber had a trilobal cross section of 1.75 modification ratio and 7.9 denier per filament (dpf).

The polypropylene fiber was then blended with a 18 denier nylon 6,6 staple product (Type 18T292, available from Du Pont Co.) at 0, 10 and 20 weight percent during carding. All test yarns were then spun into 3.5 cotton count with 5.25 twist per inch singles and 5.0 twist per inch ply. The denier uniformity as expressed in CV (standard deviation of yarn diameter divided by the average yarn denier) and spinning processability as expressed in ends down per thousand hours are recorded in Table 1 below.

TABLE 1

| | % NYLON | % PP | YARN CV | ENDS DOWN/ 1000 HOURS |
|---|---|---|---|---|
| (CONTROL) | 100 | 0 | 23.56 | 537 |
| | 90 | 10 | 20.32 | 273 |
| | 80 | 20 | 18.48 | 185 |

As shown in Table 1, the test results indicate that the yarns of this invention have higher denier uniformity and improved processability versus 100% conventional nylon staple yarns.

The test yarns were heat-set on a Suessen continuous heat-set machine, tufted into 45 oz per square yard, 0.625 inch pile height carpets and dyed in a range dyer. The REU bulk and texture retention after 5,000 cycles in a Vetterman drum are recorded below in Table 2.

TABLE 2

| | % NYLON | % PP | HEAT-SET TEMPERATURE | TEXTURE RETENTION | REU BULK |
|---|---|---|---|---|---|
| (CONTROL) | 100 | 0 | 195° C. | 3.1 | 0.432 |
| (CONTROL) | 100 | 0 | 210° C. | 3.0 | 0.420 |
| | 90 | 10 | 195° C. | 3.0 | 0.472 |
| | 80 | 20 | 195° C. | 3.7 | 0.532 |
| | 80 | 20 | 210° C. | 4.0 | 0.526 |

The test results, as shown in Table 2, clearly indicate that products of this invention have significantly improved texture retention and carpet bulk versus conventional 100% nylon staple products.

Example 2

A 35 melt flow index polypropylene (DX5A78, available from Shell Co.) polymer was spun through various spinnerets at 400 yards/minute, drawn at 1240 yards/minute and cut into 7.5 inches long 5, 10, 15, 20 and 25 denier per filament staple fibers. Nylon 66 staple fibers of 10, 15 and 18 dpf (Type T-192, T-290 and T-292, available from Du Pont Co.) were blended with the polypropylene fibers at various ratios during the carding operation and subsequently converted into 3.25 cotton count, 2 ply staple yarns at 5.75×5.5 twist per inch. The ply yarns were heat-set on a commercial Suessen heat-setting machine at 190° C. for 60 seconds.

The test items were converted into cut pile carpets of 5/8 inch pile height, 45 oz per square yard carpets on a 1/8 inch gauge tufting machine.

The yarn processability (CV), carpet bulk, and texture retention (after 5,000 cycles in a Vetterman drum) are recorded below in Table 3.

TABLE 3

| | ITEM | NYLON DPF | PP DPF | % PP | YARN CV | REU BULK | TEXTURE RETENTION |
|---|---|---|---|---|---|---|---|
| (CONTROL) | A | 10 | — | 0.0 | 20.93 | 0.471 | 2.7 |
| | D | 10 | 5 | 20.0 | 16.12 | 0.549 | 3.8 |
| | G | 10 | 15 | 20.0 | 18.34 | 0.526 | 4.0 |
| | M | 10 | 5 | 10.0 | 19.23 | 0.490 | 2.6 |
| | N | 10 | 5 | 15.0 | 17.21 | 0.500 | 3.4 |
| | O | 10 | 5 | 25.0 | 15.38 | 0.540 | 4.2 |
| | P | 10 | 5 | 30.0 | 14.50 | 0.586 | 4.4 |
| | Q | 10 | 10 | 20.0 | 17.87 | 0.520 | 4.3 |
| | R | 10 | 20 | 20.0 | 19.28 | 0.501 | 4.0 |
| | S | 10 | 25 | 20.0 | 19.65 | 0.495 | 3.8 |
| (CONTROL) | J | 18 | — | 0.0 | 23.65 | 0.504 | 2.8 |
| | T | 18 | 5 | 10.0 | 20.37 | 0.503 | 2.9 |
| | U | 18 | 5 | 15.0 | 19.44 | 0.503 | 3.4 |
| | K | 18 | 5 | 20.0 | 17.86 | 0.569 | 3.8 |
| | L | 18 | 15 | 20.0 | 20.29 | 0.555 | 3.9 |
| | V | 18 | 25 | 20.0 | 21.31 | 0.538 | 4.0 |
| (CONTROL) | W | 15 | — | 0.0 | 23.17 | 0.447 | 2.8 |
| | X | 15 | 10 | 20.0 | 19.32 | 0.483 | 3.8 |
| | Y | 15 | 15 | 20.0 | 20.44 | 0.488 | 3.9 |
| | Z | 15 | 20 | 20.0 | 20.27 | 0.549 | 4.0 |

We claim:

1. A ply-twisted yarn comprising a blend of about 70 to 90% by weight base fibers selected from the group consisting of polyamide fibers, polyester fibers, and fiber mixtures thereof, and about 10 to 30% by weight non-melt compatible polyolefin fibers having a melting point of about 130° to 170° C., wherein the polyolefin fibers are bonded to each other at contact points along the length of the yarn.

2. The yarn of claim 1, comprising a blend of 75 to 85% by weight nylon 6,6 base fibers and 15 to 25% by weight polypropylene fibers.

3. The yarn of claim 1, comprising a blend of 75 to 85% by weight nylon 6 base fibers and 15 to 25% by weight polypropylene fibers.

4. The yarn of claim 1, wherein the base fibers are crimped and have a denier per filament of about 6 to 25, and the polyolefin fibers are crimped and have a denier per filament of about 3 to 25.

5. The yarn of claim 1, wherein the base fibers are crimped and have a denier per filament of about 6 to 25, and the polyolefin fibers contain no crimp and have a denier per filament of about 3 to 25.

6. The yarn of claim 1, wherein the base and polyolefin fibers are staple fibers.

7. The yarn of claim 1, wherein the base and polyolefin fibers are bulked continuous filaments.

* * * * *